United States Patent [19]

Herley

[11] Patent Number: 4,721,978

[45] Date of Patent: Jan. 26, 1988

[54] COLOR TONER CONCENTRATION CONTROL SYSTEM

[75] Inventor: James A. Herley, Henrietta, N.Y.

[73] Assignee: Xerox Corporation, Stamford, Conn.

[21] Appl. No.: 925,578

[22] Filed: Oct. 31, 1986

[51] Int. Cl.[4] ..... G03G 15/01

[52] U.S. Cl. ..... 355/4; 355/14 D

[58] Field of Search ..... 355/30 D, 4, 14 D, 14 R; 355/14 C, 14 CU, 7

[56] References Cited

U.S. PATENT DOCUMENTS

| | | | |
|---|---|---|---|
| 3,409,901 | 11/1968 | Dost et al. | 346/74 |
| 3,529,546 | 9/1970 | Kollar | 355/14 D |
| 4,032,225 | 6/1977 | Williams | 355/30 D |
| 4,045,218 | 8/1977 | McVeigh | 355/4 X |
| 4,111,151 | 9/1978 | Ruckdeschel | 118/7 |
| 4,413,264 | 11/1983 | Cruz-Uribe et al. | 355/14 D |
| 4,416,533 | 11/1983 | Tokunaga et al. | 355/4 |
| 4,466,731 | 8/1984 | Champion et al. | 355/14 |
| 4,468,112 | 8/1984 | Suzuki et al. | 355/14 D |
| 4,492,179 | 1/1985 | Folkins et al. | 118/689 |

*Primary Examiner*—R. L. Moses
*Assistant Examiner*—J. Pendegrass
*Attorney, Agent, or Firm*—H. Fleischer; J. E. Beck; R. Zibelli

[57] ABSTRACT

An apparatus in which the concentration of toner particles used to form a highlight color document is controlled. The percentage of the document arranged to have highlight color portions thereon is determined and a first signal corresponding thereto generated. A second signal corresponding to the rate of toner particle usage per document is transmitted. A third signal corresponding to the total number of documents being reproduced is produced. The first, second and third signals are multiplied to generate a control signal corresponding to the required dispense rate for the toner particles forming the highlight color portions of the document.

18 Claims, 2 Drawing Figures

COLOR TONER CONCENTRATION CONTROL SYSTEM

Figure 1:
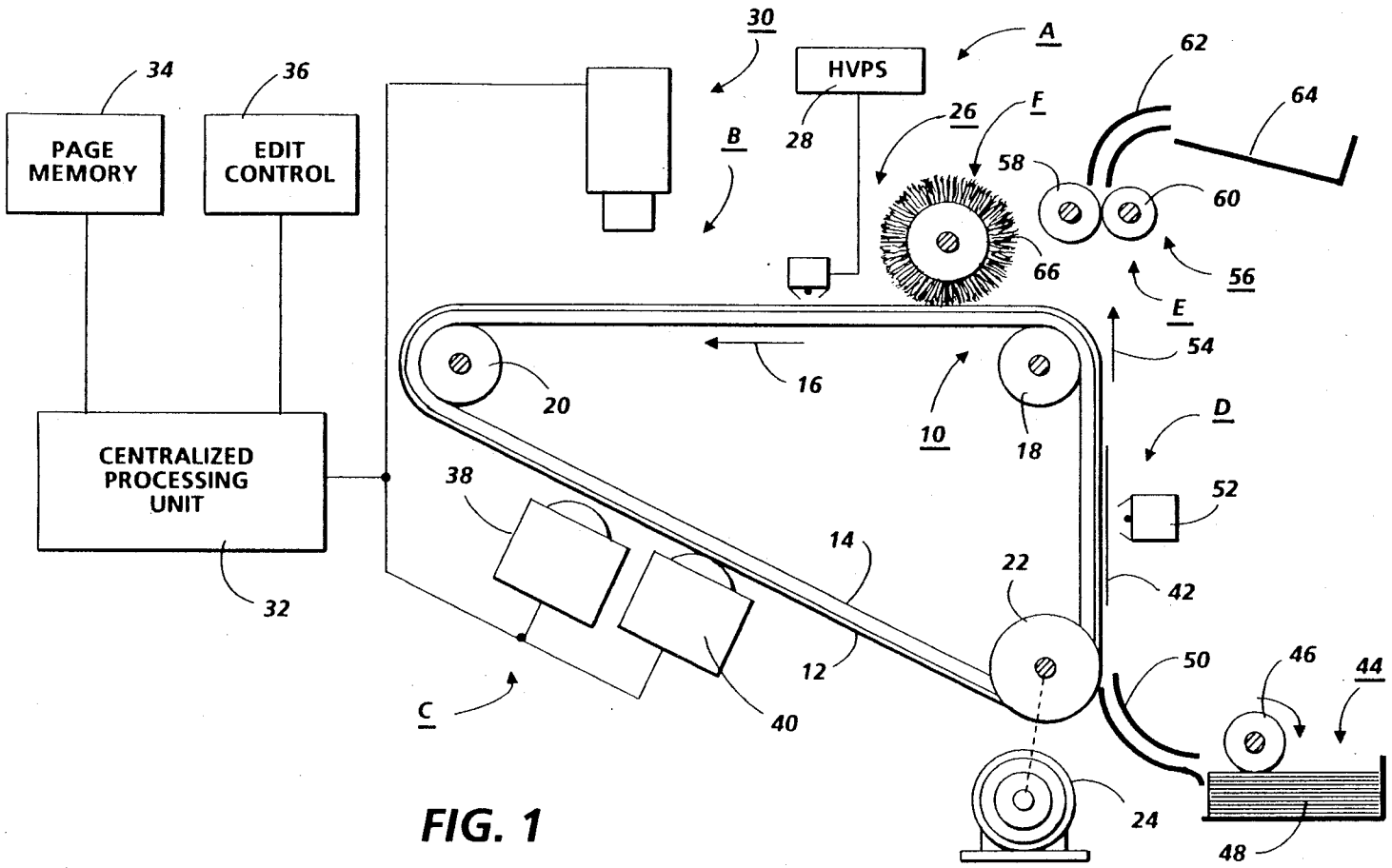

This invention relates generally to an electrophotographic printing machine, and more particularly concerns an apparatus for controlling the concentration of toner particles used to form color highlighted documents.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is heated to permanently affix it to the copy sheet in image configuration.

A common type of developer mixture frequently used in electrophotographic printing machines comprises carrier granules having toner particles adhering triboelectrically thereto. This two-component mixture is brought into contact with the photoconductive surface. The toner particles are attracted from the carrier granules to the latent image. During usage, toner particles are depleted from the developer mixture and must be periodically replenished therein. Concentration of the toner particles within the developer mixture has heretofore been controlled by devices which form a sample electrostatic latent image on the photoconductive surface and subsequently develop this latent image. The density of the toner powder image is then detected by the utilization of a an infrared light source which transmits light rays onto the toner powder image developed on the sample electrostatic latent image. The intensity of the light rays reflected from the powder image is detected. This information is then processed and utilized to regulate the discharge of toner particles into the development system. Previously, system of this type have been used with black toner particles. Attempts to employ this system with toner particles of a color other than black have proven to be difficult and expensive due to the different reflectivities of the color toner particles and the narrow bandwidth associated with their reflectivity. Additional hardware is necessary to adjust the gain compensation and special algorithms are required. The capability of maintaining the concentration of color toner particles, as well as black toner particles at optimum levels has increased in importance with the advent of color highlighting and multi-color electrophotographic printing machines.

In a color highlighting electrophotographic printing machine, selected portions of the document are reproduced in a highlight color, such as red. The remainder of the document is reproduced with black toner particles. This may be achieved by several different techniques. In one technique, selected areas of the original document are masked during the first cycle. The nonmasked areas are then reproduced with black toner particles. During the next cycle, the masked areas are unmasked and the unmasked areas are masked. During this cycle, the unmasked areas are reproduced with highlight color toner particles, e.g. red toner particles. Both the red and black toner particles are transferred to a common copy sheet. Thereafter, the copy sheet passes through the fusing device so as to permanently affix both the red and black toner particles thereto. This forms a color highlight copy. Alternatively, during one cycle, the portions selected to be reproduced with the color highlight copy may be erased from the electrostatic latent image. The remainder of the electrostatic latent image is then developed with black toner particles which are subsequently transferred to the copy sheet. During the next cycle, the other portion of the electrostatic latent image is erased, the remaining portion thereon being developed with red or color highlighting toner particles. These toner particles are then transferred to the same copy sheet. Again, this results a copy having selected portions thereof being reproduced with highlight color toner particles. Still another approach employs a laser beam to record one electrostatic latent image corresponding to the black text regions and another electrostatic latent image corresponding to the highlight color text regions. These latent images are then developed with the appropriately colored toner particles. In any case, it is evident that at least two development systems are employed. One of the development systems may use black toner particles with the other development system using the color highlighting toner particles. It is, thus, necessary not only to maintain the concentration of the black toner particles at the optimum level, but is also necessary to maintain the color highlighting toner particles at the optimum level.

Various techniques have hereinbefore been devised for controlling the concentration of toner particles within a developer mixture. The following patents appear to be relevant:

U.S. Pat. No. 3,409,901 Patentee: Dost et al. Issued: Nov. 5, 1968

U.S. Pat. No. 4,111,151 Patentee: Ruckdeschel Issued: Sept. 5, 1978

U.S. Pat. No. 4,466,731 Patentee: Champion et al. Issued: Aug. 21, 1984

U.S. Pat. No. 4,468,112 Patentee: Suzuki et al. Issued Aug. 28, 1984

U.S. Pat. No. 4,492,179 Patentee: Folkins et al. Issued: Jan. 8, 1985

The relevant portions of the foregoing patents may be briefly summarized as follows:

Dost et al. teaches an electrophotographic printing machine for reproducing copies from a cathode ray tube. A control system integrates the control signal provided to the cathode ray tube and actuates a toner supplier to add more toner to the developer material when the sump reaches a predetermined level. The system is then zeroed and the integration restarted.

Ruckdeschel adds differently colored toner particles to a common sump based upon the percentage of color in the copies being made and on the copy transmissivity. After determining the transmissivity, the percentage of a particular color is calculated the number of milligrams of each color toner used per copy is determined.

Champion et al. describes a toner concentration control system wherein the optical reflector of a developed test area is determined and the result used to replenish toner particles into the development system.

Suzuki et al. describes a system which measures and integrates the total charge on a photoconductive drum.

The signal is then used to control the addition of toner particles to the developer material.

Folkins et al. senses the total charge on the electrostatic latent image and uses this sensed signal to control the addition of toner particles to the developer material.

In accordance with one aspect of the present invention, there is provided an apparatus for controlling the concentration of toner particles used to form highlight color documents. The apparatus includes means for determining the percentage of the document arranged to have color highlighted portions thereon and generating a first signal corresponding thereto. Means transmit a second signal corresponding to the rate of toner particles usage per document. Means produce a third signal corresponding to the total number of documents being produced. Means multiply the first, second and third signals with one another to generate a control signal corresponding to the required dispense rate for the toner particles forming the color highlighted portion of the document.

Pursuant to another aspect of the present invention, there is provided a method of controlling the concentration of toner particles used to form color highlighted documents. This method includes generating a first signal corresponding to the percentage of the document arranged to have color highlighted portions thereon. A second signal is transmitted corresponding to the rate of toner particles usage per document. A third signal is produced corresponding to the total number of documents being reproduced. The first, second and third signals are multiplied to generate a control signal corresponding to the required dispense rate for the toner particles forming the color highlighted portion of the document.

In still another aspect of the present invention, there is provided an electrophotographic printing machine of the type having at least two developer units with developer material comprising different color toner particles so that the document being printed therein has a color highlighted portion. The improvement in the electrophotographic printing machine includes means for determining the percentage of the document arranged to have the color highlighted portion thereon and generating a first signal corresponding thereto. Means transmit a second signal corresponding to the rate of toner particle usage per document. Means produce a third signal corresponding to the total number of documents being produced. Means multiple the first, second and third signals with one another to generate a control signal corresponding to the required dispense rate for the toner particles forming the color highlighted portion of the document.

Figure 2:
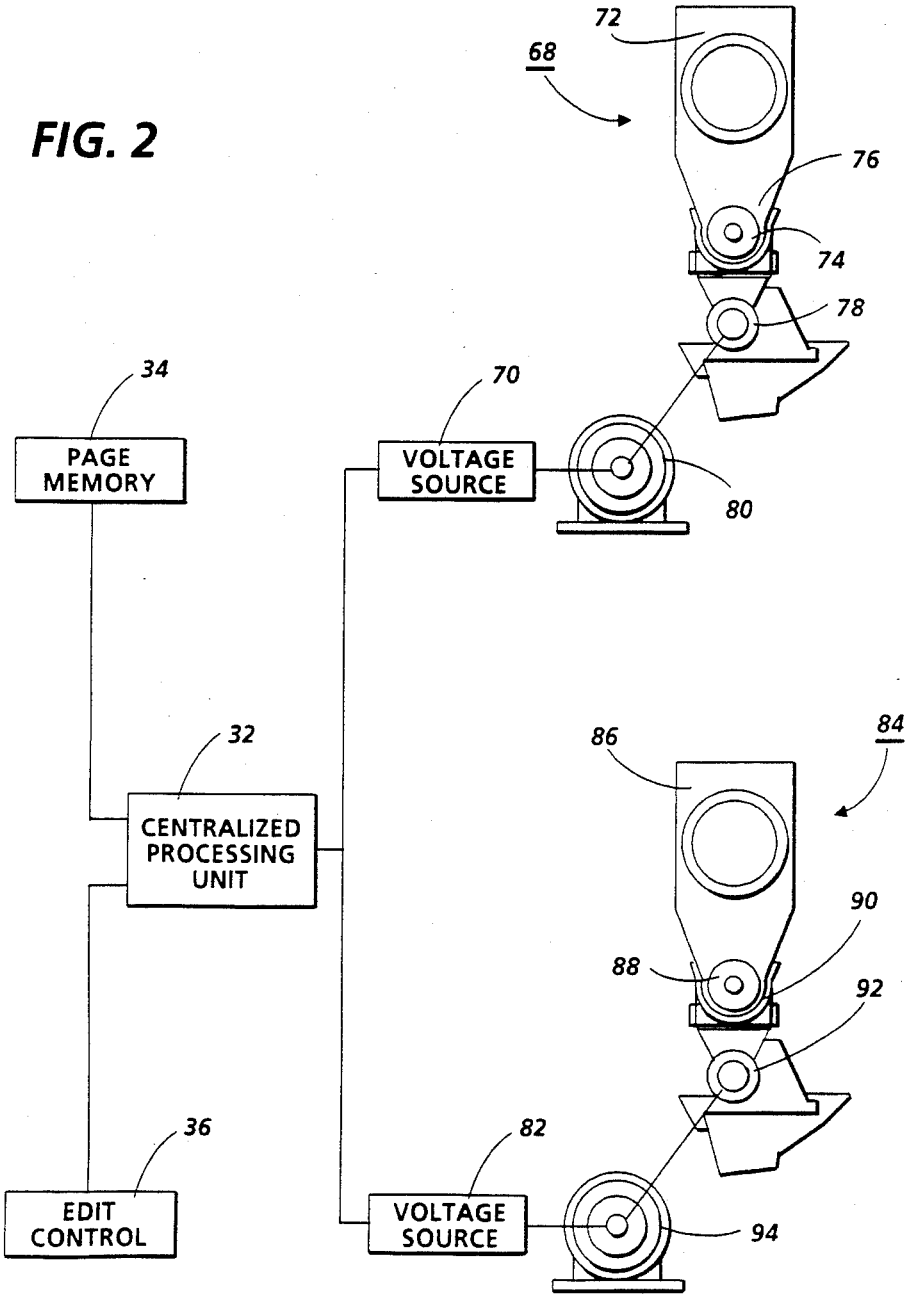

Other features of the present invention will become apparent as the following description proceeds and upon reference to the drawings, in which:

FIG. 1 is a schematic elevational view of an illustrative electrophotographic printing machine incorporating the apparatus of the present invention therein; and FIG. 2 is a diagram of a control system for regulating the concentration of toner particles in the development units employed in the FIG. 1 printing machine.

While the present invention will hereinafter be described in connection with a preferred embodiment and method of use thereof, it will be understood that it is not intended to limit the invention to that embodiment or method of use. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Referring now to FIG. 1, the electrophotographic printing machine employs a belt 10 having a photoconductive surface 12 deposited on a conductive substrate 14. By way of example, photoconductive surface 12 is made from a selenium alloy with conductive substrate 14 being made from an aluminum alloy which is electrically grounded. One skilled in the art will appreciate that photoconductive surface 12 and conductive substrate 14 may be made from any suitable materials and are not limited to selenium and aluminum alloys. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means such as a belt drive. Belt 10 is maintained in tension by a pair of springs (not shown) resiliently urging tensioning roller 20 against belt 10 with the required spring force. Both stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through writing station B At writing station B, a laser system, indicated generally by the reference numeral 30 includes a laser device which generates a laser beam modulated by a modulator in response to a signal from central processing unit 32 corresponding to the information for printing stored in a page memory 34. The modulated laser beam is reflected by a polygonal mirror rotated in a direction for effecting principle scanning, then focused by a lens and guided by deflecting mirrors onto the charged portion of photoconductive surface 12. Exposure of the charged portion of the photoconductive surface by the modulated laser beam records the desired electrostatic latent image thereon An edit control 36 also transmits a signal to the centralized processing unit which defines the portions of the page to be reproduced in a highlight color. By way of example, the centralized processing unit 32 can be composed of a microprocessor 8080 supplied by Intel Corporation and the related control units associated therewith. Thus, in operation, the page memory 34 transmits an electrical signal to centralized processing unit 32 indicating the information to be recorded on photoconductive surface 12. Similarly, edit control 36 transmits a signal to centralized processing unit 32 indicating those portions of the page to be reproduced in a highlight color. The centralized processing unit controls laser system 30 so that a first electrostatic latent image is formed on photoconductive surface 12 which corresponds to the information to be reproduced in black. Thereafter, a second electrostatic latent image is recorded on the photoconductive surface corresponding to the information to be reproduced in the highlight color.

After the electrostatic latent images have been recorded on photoconductive surface 12, belt 10 advances the latent images to development station C. Development station C includes developer units 38 and 40. Developer unit 38 is adapted to develop the electrostatic latent image with highlight color toner particles, i.e. red toner particles. Developer unit 40 is adapted to develop the electrostatic latent image with black toner particles. Each developer unit has a toner particle dispenser associated therewith. Thus, developer unit 38 includes a red toner particle dispenser whereas developer unit 40 includes a black toner particle dispenser. Actuation of the respective toner particle dispensers is controlled by central processing unit 32. In addition, central processing unit 32 selectively actuates either developer unit 38 or developer unit 40. Thus, when the electrostatic latent image corresponding to those portions of the document to be reproduced with black toner particles are advanced to development station C, developer unit 40 is moved from an inoperative position spaced from photoconductive surface 12 to an operative position closely adjacent thereto. At this time, developer unit 40, which includes a developer roller forming a magnetic brush of developer material, develops the electrostatic latent image with black toner particles. Thereafter, centralized processing units 32 de-energizes developer unit 40 by moving it to an inoperative position spaced from photoconductive surface 12. Substantially simultaneously, developer unit 38 is actuated and moved from the inoperative position spaced from photoconductive surface 12 to the operative position closely adjacent to photoconductive surface 12. Developer unit 38 includes a developer roller which forms a magnetic brush of developer material. The brush of developer material is arranged to be in contact with the photoconductive surface so that the next electrostatic latent image, i.e., electrostatic latent image adapted to be developed with red toner particles, is developed. It is apparent that depending upon the quantity of toner particles employed to develop successive electrostatic latent images, both red and black toner particles must be furnished to the respective developer units.

After the electrostatic latent images are developed, belt 10 advances the toner powder images to transfer station D. A sheet of support material 42 is advanced to transfer station D by sheet feeding apparatus 44. Preferably, sheet feeding apparatus 44 includes a feed roll 46 contacting the uppermost sheet of stack 48. Feed roller 46 rotates to advance the uppermost sheet from stack 48 into chute 50. Chute 50 directs the advancing sheet of support material into contact with photoconductive surface 12 of belt 10 in a timed sequence so that successive toner powder images formed thereon contact the advancing sheet of support material at transfer station D. Transfer station D includes a corona generating device 52 which sprays ions onto the backside of sheet 42. This attracts both toner powder images from photoconductive surface 12 to sheet 42. After transfer, sheet 42 continues to move in the direction of arrow 54 onto a conveyor (not shown) which advances sheet 42 to fusing station E.

Fusing station E includes a fuser assembly indicated generally by the reference numeral 56, which permanently affixes the transferred powder images to sheet 42. Preferably, fuser assembly 56 comprises a heated fuser roller 58 and a back-up roller 60. Sheet 42 passes between fuser roller 58 and back-up roller 60 with the toner powder images contacting fuser roller 58. In this manner, the toner powder images are permanently affixed to sheet 42. After fusing, chute 62 advances sheet 42 to catch tray 64 for subsequent removal from the printing machine by the operator.

After the sheet of support material is separated from photoconductive surface 12 of belt 10, the residual toner particles adhering to photoconductive surface 12 are removed therefrom at cleaning station F. Cleaning station F includes a rotatably mounted fibrous brush 66 in contact with photoconductive surface 12. The particles are cleaned from photoconductive surface 12 by the rotation of brush 66 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for the purposes of the present invention to illustrate the general operation of an electrophotographic printing machine incorporating the features of the present invention therein.

Referring now to FIG. 2, there is shown the manner in which the concentration of toner particles within the respective developer units is regulated. As shown thereat, page memory 34 transmits an electrical signal to the central processing unit 32 which defines the text to be reproduced. Edit control 36 transmits an electrical signal to central processing unit 32 which defines the selected portion of the text which is to be in a highlight color. Central processing unit 32 develops a signal which is a function of the percentage of area of the document to be highlighted in a color other than black. This is achieved by dividing the signal from edit control 36 by the signal from page memory 34. The resultant signal is a function of the percentage of the document adapted to be reproduced in a highlight color. The central processing unit 32 also determines the amount of toner required to reproduce the entire document transmitted from page memory 34 in black toner. This, in turn, permits the central processing unit 32 to define the required rate of toner particle usage per document. The key operator actuates the printing machine control panel to select the total number of documents to be reproduced. In addition, the key operator can also select the portions of the copy to be reproduced in the highlight color by selecting the coordinates of the highlight color portion on the key pad on the control panel. The signal from the control panel corresponding to the selected color highlight coordinates is transmitted to edit control 36 and the signal corresponding to the number of copies to be made is transmitted to central processing unit 32. The central processing unit 32 generates a third signal corresponding to the total number of documents being reproduced. Thereafter, the central processing unit 32 multiplies the first signal, corresponding to the percentage of the document color highlighted, with the second signal, corresponding to the rate of toner particle usage per document, and the third signal, corresponding to the total number of documents being produced, to generate a control signal, corresponding to the required dispense rate for the highlight color toner particles. This control signal is employed to regulate the discharge of toner particles from a toner dispenser, indicated generally by the reference numeral 68, associated with developer unit 38 (FIG. 1). As shown in FIG. 2, the centralized processing unit 32 transmits the control signal to voltage source 70. The control signal from centralized processing unit 32 regulates the output voltage from voltage source 70 so as to control the furnishing of additional toner particles to developer unit 38. Toner dispenser 68 is disposed in development unit 38. Toner dispenser 68 includes a container 72 storing a supply of toner particles therein. A suitable roller 74 is disposed in chamber 76 coupled to container 72 for dispensing toner particles into auger 78. By way of example, auger 78 comprises a helical spring mounted in a tube having a plurality of apertures therein. Motor 80 rotates the helical member of auger 78 so as to advance the toner particles through the tube. The toner particles are then dispensed from the apertures thereof into the chamber of the development system housing for use by the developer roller of developer unit 38. Energization of motor 80 is controlled by voltage source 70. Voltage source 70 is connected to central processing unit 32. In this way, the amount of toner particles being dispensed into the highlight color developer unit corresponds to the amount of toner particles being used to develop the color highlight portion of the electrostatic latent images. This insures that the overall concentration of the toner particles within developer unit 38 is maintained substantially constant. Central processing unit 32 also develops a fourth signal as a function of the product of the second signal, corresponding to the rate of toner particle usage per document, and the third signal, corresponding to the total number of documents being reproduced. The control signal is subtracted from the forth signal to generate a regulating signal corresponding to the required dispense rate for the toner particles used to form the unhighlighted portions of the document, e.g. the black toner particles. This regulating signal corresponds to the required dispense rate for the toner particles forming the unhighlighted portion of the document, i.e. the black toner particles. This regulating signal is utilized to control the dispensing of toner particles into developer unit 40. Central processing unit 32 transmits the regulating signal to voltage source 82. The regulating signal from central processing unit 32 regulates the output voltage from voltage source 82 so as to control the furnishing of additional toner particles to developer unit 40. The toner dispenser, indicated generally by the reference numeral 84 is disposed in developer unit 40. Toner dispenser 84 includes a container 86 storing a supply of toner particles therein. A suitable roller 88 is disposed in chamber 90 coupled to container 86 for dispensing toner particles into auger 92. Auger 92 is substantially identical to auger 78 and comprises a helical spring mounted in a tube having a plurality of apertures therein. Motor 94 rotates the helical element of auger 92 so as to advance the toner particles through the tube. The toner particles are then dispensed from the aperture thereof into the chamber of developer unit 40 for use by the developer roller thereof. Energization of motor 94 is controlled by voltage source 82. As previously noted, voltage source 82 is connected to central processing unit 32 and is controlled by the regulating signal generated therefrom.

In recapitulation, it is evident that the system of the present invention controls the dispensing of color highlight toner particles and black toner particles. In both cases, the rate of dispensing the toner particles into the respective developer units corresponds to the usage rate. Thus, the rate of toner particles being dispensed into the respective developer units is equal to the rate that the toner particles are being used. In this way, the toner particle concentration within each of the developer units remains substantially constant. This is achieved by determining the percentage of area coresponding to the color highlight portion of the document. This percentage is then multiplied by the rate of toner particle usage per document. This product is then multiplied by the total number of documents being generated to produce a control signal which corresponds to the required dispense rate for the toner particles forming the color highlighted portion of the document. Another signal is generated as a product of the rate of toner particle usage per document and the total number of documents. This signal corresponds to the total amount of toner particles required. The signal corresponding to the required dispense rate for the color highlight toner particles is subtracted from this latter signal to produce a regulating signal corresponding to the required dispense rate for the toner particles developing the unhighlighted portion of the document, i.e. the black toner particles. Thus, the dispense rate for both the color highlight toner particles and the black toner particles is regulated to maintain the concentration thereof substantially in equilibrium. The apparatus of the present invention predispenses toner particles to meet the requirements for higher color concentration documents. Prior art systems react to low level signals indicating the need for additional toner particles to maintain the developer material at the desired concentration, i.e. they act after the fact. This apparatus is a feed forward system, i. e. a type of artificial intelligence, which anticipates the need for additional toner particles and only supplies enough additional toner particles to meet this need. Thus, the apparatus of the present invention minimizes contamination and material usage rates while optimizing material life It is, therefore, apparent that there has been provided in accordance with the present invention, an apparatus for regulating the dispensing of both black toner particles and color highlight toner particles into their respective developer units so as to maintain the concentration of toner particles in the respective developer units substantially constant. This apparatus fully satisfies the aims and advantages hereinbefore set forth. While this invention has been described in conjunction with a specific embodiment and method of use thereof, it is evident that many alternatives, modifications and variations will be apparent to those skilled in the art. Accordingly, it is intended to cover all such alternatives, modifications and variations as fall within the spirit and broad scope of the appended claims.

I claim:

1. An apparatus for controlling the concentration of toner particles used to form highlight color documents, including:

means for determining the percentage of the document arranged to have highlight color portions thereon and generating a first signal corresponding thereto;

means for transmitting a second signal corresponding to the rate of toner particle usage per document;

means for producing a third signal corresponding to the total number of documents being produced; and means for multiplying the first, second and third signals with one another to generate a control signal corresponding to the required dispense rate for the toner particles forming the highlight color portion of the document.

2. An apparatus according to claim 1, further including means, responsive to the control signal, for dispensing highlight color toner particles.

3. An apparatus according to claim 2, further including means for developing a fourth signal as a function of the product of the second signal and the third signal.

4. An apparatus according to claim 3, further including means for subtracting the control signal from the fourth signal to generate a regulating signal corresponding to the required dispense rate for the toner particles used to form the unhighlighted portions of the document.

5. An apparatus according to claim 4, further including means, responsive to the regulating signal, for discharging toner particles used to form the unhighlighted portions of the document.

6. An apparatus according to claim 5, wherein said determining means includes:

means for forming a fifth signal corresponding to the size of the document; and means for creating a sixth signal corresponding to the size of the highlight color portions of the document with the first signal being a function of the sixth signal divided by the fifth signal.

7. A method of controlling the concentration of toner particles used to form highlight color documents, including the steps of:

generating a first signal corresponding to the percentage of the document arranged to have highlight color portions thereon;

transmitting a second signal corresponding to the rate of toner particle usage per document;

producing a third signal corresponding to the total number of documents being reproduced; and multiplying the first, second and third signals with one another to generate a control signal corresponding to the required dispense rate for the toner particles forming the highlight color portions of the document.

8. A method according to claim 7, further including the step of dispensing highlight color toner particles in response to the control signal.

9. A method according to claim 8, further including the step of developing a fourth signal as a function of the product of the second signal and the third signal.

10. A method according to claim 9, further including the step of subtracting the control signal from the fourth signal to generate a regulating signal corresponding to the required dispense rate for the toner particles used to form the unhighlighted portions of the document.

11. A method according to claim 10, further including the step of discharging toner particles used to form the unhighlighted portions of the document in response to the regulating signal.

12. A method according to claim 11, wherein said step of generating a first signal includes the steps of:

forming a fifth signal corresponding to the size of the document; and creating a sixth signal corresponding to the size of the highlight color portions of the document with the first signal being a function of the sixth signal divided by the fifth signal.

13. An electrophotographic printing machine of the type having at least two developer units with developer materials comprising different color toner particles therein so that the document being printed has highlight color portions, wherein the improvement includes:

means for determining the percentage of the document arranged to have the highlight color portions thereon and generating a first signal corresponding thereto;

means for transmitting a second signal corresponding to the rate of toner particle usage per document;

means for producing a third signal corresponding to the total number of documents being produced; and means for multiplying the first, second and third signals with one another to generate a control signal corresponding to the required dispense rate for the toner particles forming the highlight color portions of document.

14. A printing machine according to claim 13, further including means, responsive to the control signal, for dispensing one of the toner particles.

15. A printing machines according to claim 14, further including means for developing a fourth signal as a function of the product of the second signal and the third signal.

16. A printing machine according to claim 15, further including means for subtracting the control signal from the fourth signal to generate a regulating signal corresponding to the required dispense rate for the other toner.

17. A printing machine according to claim 16, further including means, responsive to the regulating signal, for discharging the other toner particles.

18. A printing machine according to claim 17, wherein said determining means includes:

means for forming a fifth signal corresponding to the size of the document; and means for creating a sixth signal corresponding to the size of the highlight color portions of the document with the first signal being a function of the sixth signal divided by the fifth signal.

* * * * *